US005908289A

United States Patent [19]

Schwuchow et al.

[11] Patent Number: 5,908,289

[45] Date of Patent: Jun. 1, 1999

[54] GEAR MACHINES WITH IMPROVED KINEMATICS

[75] Inventors: Dietmar Schwuchow, Sindelfingen; Karl-Heinz Hirschmann, Stuttgart; Gisbert Lechner, Böblingen; Klaus Riedl, Tübingen, all of Germany

[73] Assignee: Robert Bosch GmbH, Stuttgart, Germany

[21] Appl. No.: 08/804,942

[22] Filed: Feb. 24, 1997

[30] Foreign Application Priority Data

Mar. 29, 1996 [DE] Germany ..... 196 12 498

[51] Int. Cl.[6] ..... F01C 1/20; F03C 2/08; F04C 2/20

[52] U.S. Cl. ..... 418/150; 418/191

[58] Field of Search ..... 418/150, 191, 418/206.5

[56] References Cited

U.S. PATENT DOCUMENTS 5,639,230 6/1997 Lechner et al. ..... 418/191

FOREIGN PATENT DOCUMENTS 0539396 2/1992 European Pat. Off. .

0569725A1 3/1993 European Pat. Off. .

3417832A1 11/1985 Germany .

4022500A1 1/1992 Germany .

*Primary Examiner*—John J. Vrablik

*Attorney, Agent, or Firm*—Michael J. Striker

[57] ABSTRACT

The gear machine according to the invention includes a driving gear wheel (1) and a driven gear wheel (2) having meshing gear teeth (21,22) having a special novel shape designed to provide improved gear wheel kinematics as well as minimal volume flow rate fluctuations. A correction of the gear teeth side geometry is performed by local limited adjustment of the basic transmission function i for eliminating volume flow rate fluctuations so that a discontinuity-free transmission is attained which results in an improved motion of the driven gear wheel with reduced acceleration changes. In order to accomplish this improvement in kinematics, the shape of the flanks or sides (25,26) of the engaging or meshing gear teeth (21,22) is such that the transmission function i depends on a spacing ($g_{\alpha y}$) of an instantaneous contact point (Y) from a pitch point (C) of the two gear wheels (1,2) and changes continuously with a continuous derivative with a zero derivative at a gear tooth engagement change point occurring at a maximum value of that spacing ($g_{\alpha y}$).

6 Claims, 3 Drawing Sheets

GEAR MACHINES WITH IMPROVED KINEMATICS

BACKGROUND OF THE INVENTION

The present invention relates to gear machines with improved kinmeatics, especially to gear pumps or motors, comprising two gear wheels rotatably mounted in a housing, whose gear teeth are engaged or mesh with each other and which separate a pressurized chamber and a lower pressure or outflow chamber from each other, whereby an instantaneous volume flow rate $dV/d\phi_1$ of hydraulic medium is produced and the gear teeth meshing with each other have a transmission function or gear ratio $i=d\phi_1/d\phi_2$.

Hydrostatic drive systems are used in many engineering fields. Displacement machines of various structural types are used for conversion of hydraulic energy. For continuous or constant pumping the gear pumps and especially the exteriorly toothed gear pumps have been most widely used. The principle reason for this is their simple structure. This leads to high efficiency and high reliability, even with difficult operating conditions, and allows economical mass production. Moreover the exteriorly toothed gear pump has the advantages of comparatively low weight and compactness because of the high energy density.

Gear machines are generally built with at least one pair of gear wheels which comprise two exteriorly toothed gear wheels (exteriorly toothed gear pump, e.g. as in FIG. 1 here) or an exteriorly and internally toothed gear wheel (internally toothed gear pump). An externally toothed gear wheel is driven and its rotary motion is translated or converted by the second exteriorly or internally toothed gear wheel. The front and rear sides of the gear teeth of the gear wheel differ according to the rotation direction. The front sides transfer the rotary motion from the driving to the driven gear wheel. In a gear pump the medium to be fed is supplied in a known way through the gear teeth gaps from the lower pressure chamber into the higher pressure or pressurized chamber. The gear teeth flanks or sides coming into engagement with each other prevent the reverse flow of the medium from the pressurized chamber into the lower pressure chamber. Since the position of engagement, i.e. the instantaneous contact point of both tooth flanks or gear teeth sides changes constantly during the engagement of the gear teeth in relation to the locally fixed housing, volume flow variations occur and, as a result, pressure fluctuations in the pressurized space or chamber occur in synchronization with the gear teeth engagement frequency.

The applications for exteriorly toothed gear pumps are frequently more limited, because of their undesirable noise properties in comparison to internally toothed gear pumps. This is particularly disadvantageously noticeable in combination with other hydraulic equipment. Besides the running noise produce by the meshing gear teeth the volume flow fluctuations called for by the periodic gear teeth engagement stimulate or excite pressure fluctuations and noise in the entire closed hydraulic system. Thus an effective reduction of its noise generation is necessary for maintaining and especially for increasing the applicability of exteriorly toothed gear pumps. A start has been made by definite reduction of the volume flow pulsations occurring in operation. Suitable experiments in past years utilize parameter optimization of involute gear teeth and lead to solutions such as the introduction of play-free gear toothing or use of two gear wheel pairs displaced relative to each other in a Duo-pump.

As constant as possible volume flow rate is provided for noise reduction in gear pumps described in German Patent Document DE 4022500 A1, U.S. Pat. No. 5,639,230 and in European Patent Document EP 0539396 B1. The instantaneous volume flow rate, $dV/d\phi_1$ of hydraulic medium of the gear pump or gear motor is given by the following general formula I:

$$dV/d\varphi_1 = \frac{b}{2}\cdot\left[\left(r_{a1}^2 + \frac{1}{i}r_{a2}^2\right) - (1+i)r_{w1}^2 - \left(1+\frac{1}{i}\right)g_{\alpha y}^2\right], \quad \text{(I)}$$

wherein $\phi_1$ and $\phi_2$ are the angular positions of the driving and driven gear wheels respectively, $r_{a1}$ and $r_{a2}$ are the crown circle radii of the driving and driven gear wheels respectively, b is the gear tooth width of the gear teeth of gear wheels 1 and 2 respectively, and $i=d\phi_1/d\phi_2$, the transmission function or gear ratio between the driving gear wheel 1 and the driven gear wheel 2, $r_{w1}$ is the drive wheel radius of the driving wheel 1 and $g_{\alpha y}$ is the spacing of the instantaneous contact point Y from the pitch point C. The spacing $g_{\alpha y}$ depends on the angular position $\phi_1$ of the driving wheel.

If one substitutes the relationship between the drive wheel radius $r_{w1}$ and the center distance $a_w$ between the gear wheels in the formula I above for the instantaneous volume flow rate, one obtains the following formula II of the instantaneous volume flow rate $$dV/d\varphi_1 = :\frac{b}{2}\cdot\left[\left(r_{a1}^2 + \frac{1}{i}r_{a2}^2\right) - \frac{1}{1+i}a_w^2 - \left(1+\frac{1}{i}\right)g_{\alpha y}^2\right]. \quad \text{(II)}$$

The crown circle radii $r_{a1}$ and $r_{a2}$, the gear tooth width b and the center distance $a_w$ between the gear wheels in this formula II are geometric variables describing the gear structure. The spacing gay is the spacing of the instantaneous contact point Y from the pitch point C fluctuates between two extreme values in synchronization with the gear teeth engagement frequency. In order to compensate for the volume flow fluctuations the gear teeth should be designed according to the disclosure in German Patent Document DE 4022500 A1 and in European Patent Document EP 0539396 B1 so that the dependence of the remaining variable, namely the transmission function i, during the engagement of the gear teeth according to the spacing $g_{\alpha y}$ is set or determined so that the resulting volume flow rate fluctuations are null or zero. This is accomplished by setting equation II above constant.

However difficulties can result during actual operation with the gear teeth shape calculated with these relationships. The resulting gear teeth flank or side geometry leads to a transmission behavior with this special gear wheel teeth structure which has a discontinuity at the gear tooth engagement change point. This has the consequence that the angular acceleration of the driven gear wheel instantly and discontinuously changes from a positive to a negative value. The occurring force change, especially unloading, at the contact point of the gear teeth sides can have a negative effect on the feed behavior and the noise behavior of the gear device at predetermined operating points.

SUMMARY OF THE INVENTION

It is an object of the present invention to provide a gear machine with an improved gear device of the above-described type which does not have the above-described disadvantages.

This object and others which will be made more apparent hereinafter are attained in a gear machine, particularly a gear pump or motor, comprising a housing, a pressurized chamber for a hydraulic medium in the housing, a lower pressure chamber, i.e. a vacuum chamber or outflow chamber, in the housing communicating with the pressurized chamber and a gear device separating the pressurized chamber from the lower pressure chamber, wherein the gear device comprises two gear wheels rotatably mounted in the housing which have engaging or meshing gear teeth, the instantaneous volume flow rate $dV/d\phi_1$ of the hydraulic medium is changed according to the angular position $\phi_1$ of the driving wheel and the meshing gear wheels have a transmission function $i=d\phi_1/d\phi_2$ (where $\phi_2$ is the angular position of the driven gear wheel) which is selected so that the driven gear wheel is operated with a continuously changing angular speed repeating periodically for each gear teeth division, whereby the volume flow rate fluctuations resulting from the continuous position change of a sealing boundary at an instantaneous contact point Y between the meshing gear teeth is at least partially compensated by feeding more or less hydraulic medium between the chambers.

According to the invention, the shape of the flanks or sides of the meshing teeth of the gear wheels is such that the transmission function i is continuous and depends on the spacing $g_{\alpha y}$ of the instantaneous contact point Y from the pitch point C of the meshing gear wheels and has a horizontal tangent, i.e. a continuous derivative equal to 0, at the gear tooth engagement change point which occurs at a maximum value in the spacing $g_{\alpha y}$ of the instantaneous contact point Y from the pitch point C The gear machine according to the invention has the advantage that a substantial improvement of the kinematics of the gear wheel pair is obtainable with it. Instead of the discontinuity in transmission behavior a smooth or discontinuity-free continuously-changing-tangent transmission function behavior is obtained which leads to an improved operation with minimal acceleration changes for the driven gear. A continuous transition between acceleration and braking phases is provided in the engagement change region. The transmission is thus harmonized which also advantageously effects the noise production of the gear machine. Also the transmission fluctuations are reduced and thus improved during the meshing of the gear wheels.

Other advantages and advantageous embodiments are described in the appended dependent claims and in the detailed description hereinbelow.

Thus the harmonized transmission may result when the instantaneous volume flow rate is set to a constant value and may also then be applicable when a limited volume flow rate is given. Thus the volume flow rate pulsations are only partially compensated in order to attain an improved more practical usable shape for the sides or flanks of the meshing gear teeth of the gear wheels of the gear machine according to the invention.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
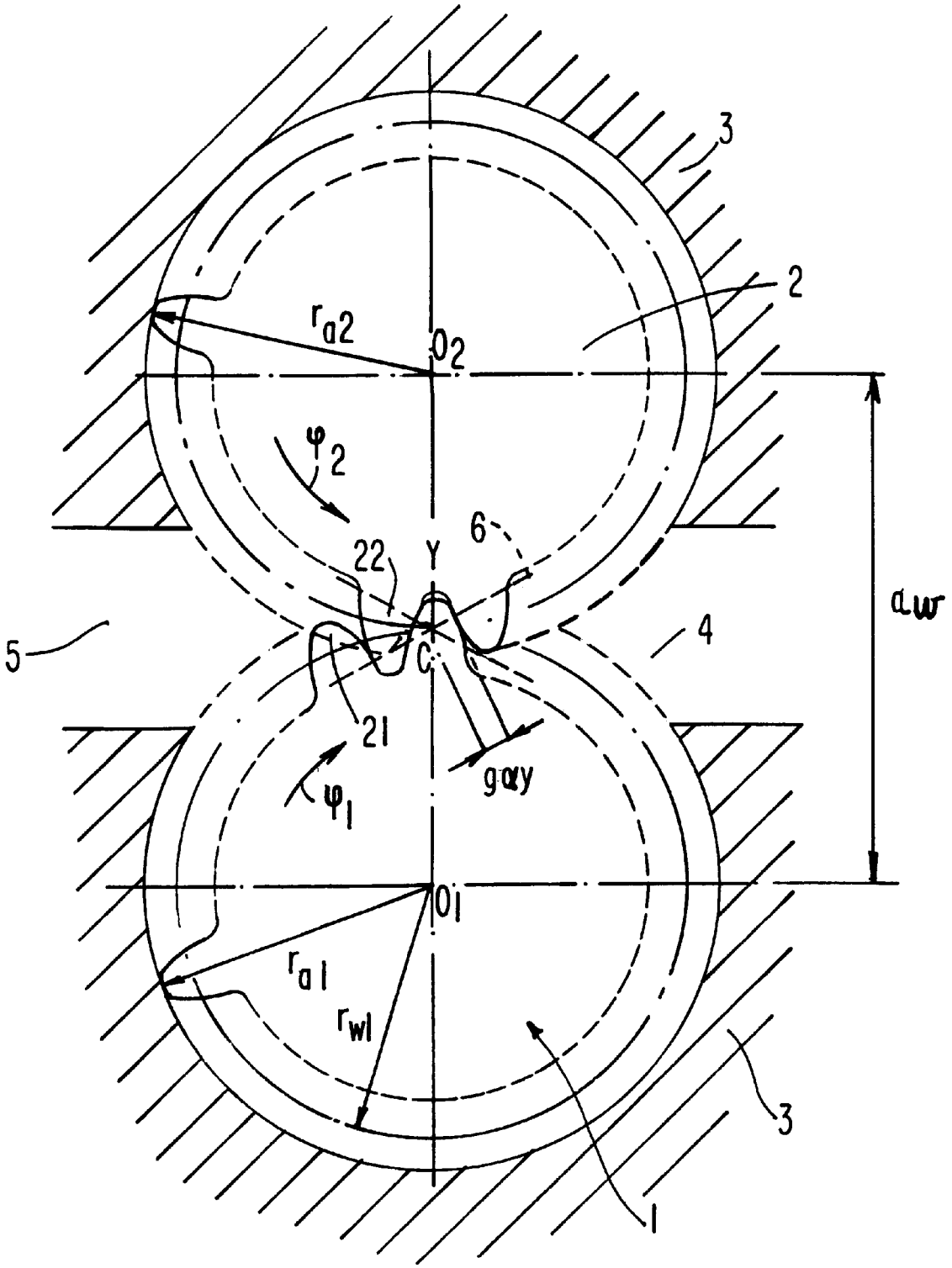
FIG. 1 is a schematic cross-sectional view through a generally known gear machine for illustration of its basic structure.
Figure 2:
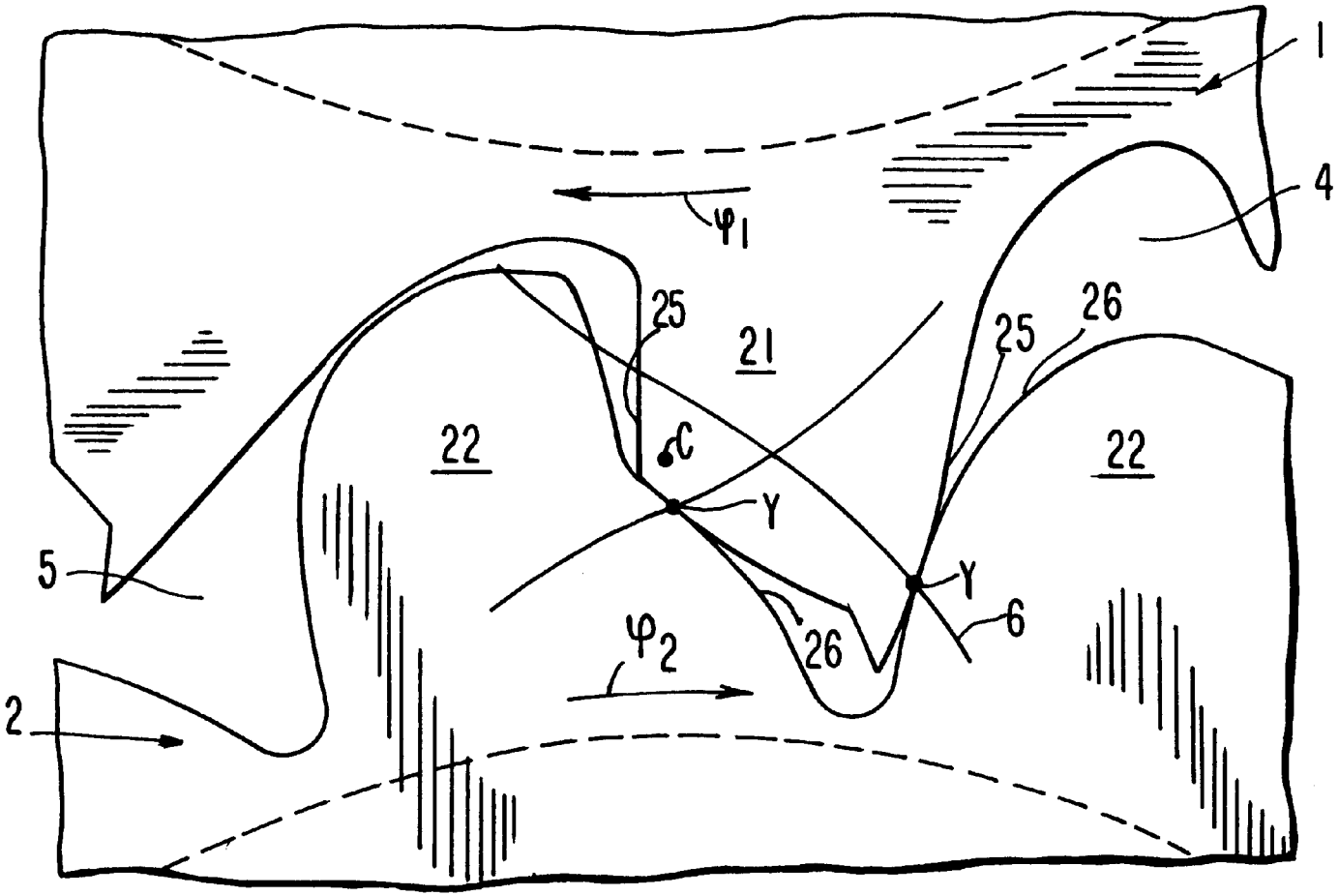
FIG. 2 PRIOR ART
FIG. 2 is a greatly simplified detailed cross-sectional view of the shape of the gear teeth and gaps in a special embodiment of meshing gear teeth for minimizing volume flow rate fluctuations according to the above-described state of the art.

FIGS. 1 and 2 show a generally known gear machine comprising a pressurized chamber 5 in a housing 3, and lower pressure chamber 4 communicating with the pressurized chamber 5 through a pair of meshing gear wheels 1,2 which separate the higher pressure pressurized chamber 5 from the lower pressure chamber 4. The meshing gear wheels 1,2 consist of a driving wheel 1 and a driven wheel 2 with meshing gear teeth 21, 22 on their outer peripheral surfaces. The gear machine shown in FIG. 1 is an embodiment of the gear machine according to the invention when the sides or flanks 25,26 of the gear teeth 21,22 are shaped according to the invention, but is a gear machine of the prior art when the gear teeth are shaped according to the prior art as discussed above and as shown in FIG. 2.

In FIGS. 1 and 2 $\phi_1$, and $\phi_2$ are the angular positions of the driving wheel 1 and driven wheel 2 respectively, $r_{a1}$ and $r_{a2}$ are the crown circle radii of the driving and driven wheel respectively, b is the gear tooth width and $a_w$ is the distance between the centers of gear wheels 1 and 2. The spacing $g_{\alpha y}$ of the instantaneous contact point Y from the pitch point C varies as the meshing gear wheels 1 and 2 rotate and the path of the instantaneous contact point Y is shown in FIG. 2 via the curve 6.

The improvement of the kinematics of the gear wheel pair 1,2 with meshing gear teeth 21,22 for minimal volume flow rate fluctuations is essential for the invention. A discontinuity-free, continuously-changing-tangent transmission behavior, by which a desired motion path of the driven gear wheel 2 with reduced jump-free acceleration changes results, is attained by adjustment of or fitting the transmission function i. At the same time the transmission fluctuation i during each tooth engagement is reduced in a satisfactory way. The design of the gear machine for pulsation-free and/or weakly pulsating flow proceeds according to the mathematical equation III obtained from equation II for instantaneous volume flow rate $$dV/d\varphi_1 = \{V_g/2\pi\}[1 - f(g_{\alpha y})] = : \frac{b}{2}\cdot\left[\left(r_{a1}^2 + \frac{1}{i}r_{a2}^2\right) - \frac{1}{1+i}a_w^2 - \left(1+\frac{1}{i}\right)g_{\alpha y}^2\right]. \quad \text{(III)}$$

From equation III in which $V_g/2\pi$ represents the maximum instantaneous feed volume, the transmission function $i(g_{\alpha y})$ may be derived, whereby a definite feed relationship $dV/d\phi_1$ $(g_{\alpha y})$ is given. The transmission function i, as it is described in more detail in EP 0 539 396 B1 and its U.S. Pat.

No. 5,639,230, forms the basis for calculation of the shape of the teeth flanks or sides for the gear machine with pulsation-free feed or with only weak pulsations according to the prior art.

Figure 3:
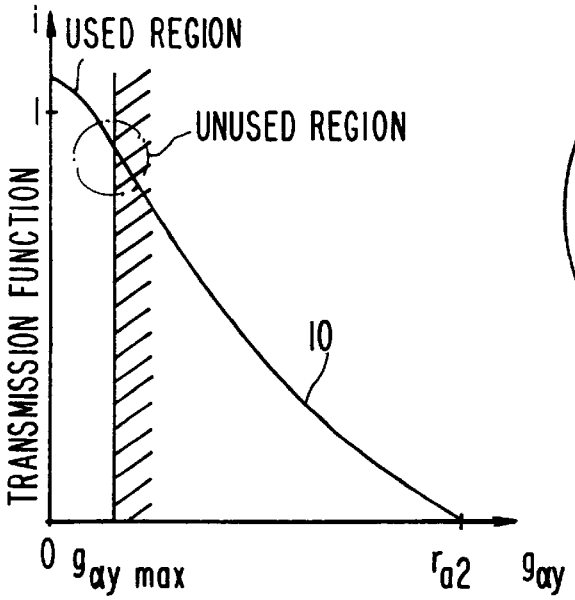
FIG. 3 PRIOR ART
FIG. 3 is a graphical illustration of the relationship of the transmission function i to the spacing $g_{\alpha y}$ of the instantaneous contact point Y from the pitch point C for the gear machine according to the prior art.
Figure 4:
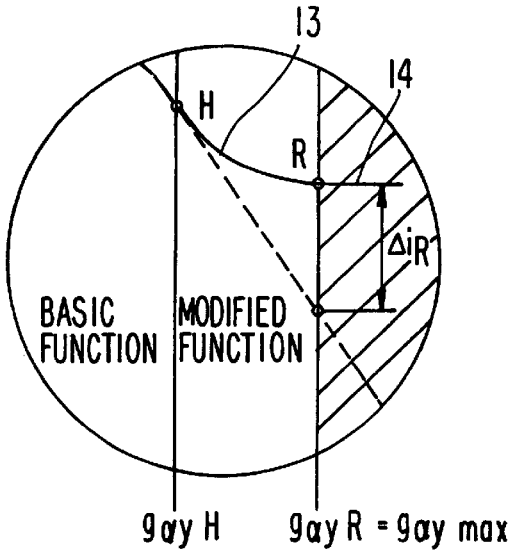
FIG. 4 is a graphical illustration of the periodic behavior of the transmission function versus a tooth engagement parameter for the prior art gear machine shown in FIG. 3.

During meshing of both gear wheels 1 and 2 the spacing $g_{\alpha y}$ decreases from a maximum value of $g_{\alpha y\ max}$ until at a value of zero and increases again back to the maximum value of $g_{\alpha y\ max}$ after that. FIG. 3 now shows the transmission function $i(g_{\alpha y})$ for the prior art gear machine, in which the transmission i depends on the spacing $g_{\alpha y}$. The curve 10 in FIG. 3 has a negative slope at the edge of the practically useable $g_{\alpha y}$-value region shown in detail by the circled portion on FIG. 3. FIG. 4 shows the dependence of the associated transmission function i on the rotational angle $\phi_1$ for the associated gear teeth of the driving gear wheel 1. The curve 11 in FIG. 4 clearly shows that the negative slope of the transmission function leads here to a discontinuity 12 at the teeth engagement change position of the meshing gear wheels 1,2. Although no transmission discontinuity occurs here at the transition to the next teeth engagement, the gradient of the transmission function changes discontinuously at the discontinuity 12 and, as a consequence, also the angular speed of the driven gear wheel changes discontinuously, which leads to an abrupt change of the angular acceleration with simultaneous sign change. The known special gear teeth of meshing gear wheels used for minimizing and eliminating volume flow fluctuations in gear pumps and/or other machines of the prior art behave according to the relationships of the transmission function shown in FIG. 3 and in FIG. 4. These relationships are the basis for characterizing the behavior of the transmission shown in FIG. 4 as not harmonizing.

Figure 5:
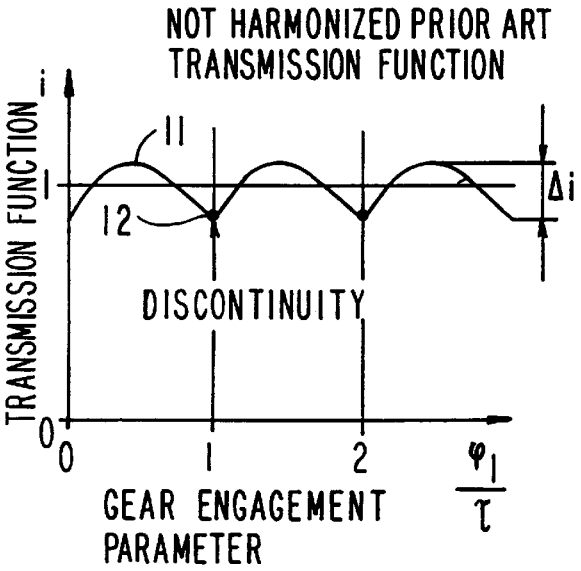
FIG. 5 PRIOR ART
FIG. 5 is a cutaway detailed view of a portion of a graphical illustration of the relationship of the transmission function i to the spacing $g_{\alpha y}$ of the instantaneous contact point Y from the pitch point C for the gear machine according to the invention.

FIG. 5 shows the relationship of the transmission function i to the spacing $g_{\alpha y}$ of the instantaneous contact point Y from the pitch point C in another gear machine similar to that of FIG. 3, but in which the transmission function is determined according to the invention, since the ell, basic prior art transmission function $i(g_{\alpha y})$ is now modified t=in a narrow limited range at the edge of the used $i(g_{\alpha y})$ region by introducing an arc-shaped bend 13 in the transmission function. As FIG. 5 clearly shows the arc-shaped bend 13 joins the basic prior art transmission function tangentially at the point H. The arc-shaped bend 13 is adjusted so that it has a horizontal tangent 14 at point R at the position $g_{\alpha y\ max}$. In other words, the transmission function is corrected so that $$(di/dg_{\alpha y})_{g\alpha y=g\alpha y\ max}=0$$

Figure 6:
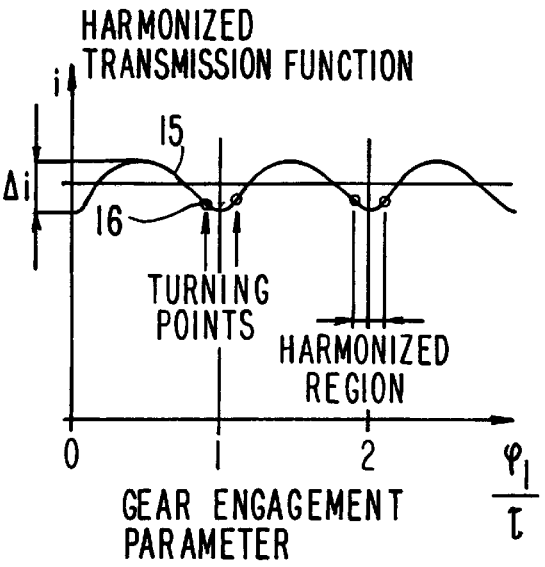
FIG. 6 is a graphical illustration of the periodic behavior of the transmission function versus a tooth engagement parameter for the gear machine according to the invention shown in FIG. 5.

A slight variation $\Delta i_R$ relative to the original instantaneous transmission according to the basic prior art function results. When the transmission function thus optimized is referred to for calculation of the tooth side geometry of the meshing gear wheels 1,2, a continuous transmission behavior $i(\phi_1)$ results without discontinuities or abrupt changes as illustrated in the associated FIG. 6. A comparison of the curve 15 shown in FIG. 6 with the curve 11 shown in FIG. 4 clearly shows that, instead of a discontinuity 12, now a turning points 16 are formed, between which the transmissions are harmonized and thus a continuously-changing-tangent continuous transmission between acceleration and braking phases is provided. Thus the abrupt acceleration changes for the driven gear wheel 2 occurring up to now at gear teeth engagement changes in a weakly pulsating gear pump with nonuniform transmission are avoided by the correction of the gear teeth flank or side shape or geometry, since the local discontinuous-tangent transmission behavior is replaced by a continuously-changing-tangent transmission behavior. The side shape of the teeth however only changes slightly by introduction of this harmonization.

The adjustment of the transmission function can be performed both in gear machines in which the transmission function is designed to provide a pulsation or fluctuation-free feed and also in gear machines which still allow a relatively small feed fluctuation in order to attain an optimum side shape for the teeth of the gear wheels. The rounding or the arc-shaped bend in the transmission function can be shaped like a section of a circle or circular arc, or like a section of an ellipse or other continuous curve, if it provides a horizontal tangent at the point $g_{\alpha y\ max}$ and it is tangentially continuously connected to the basic unmodified prior art transmission function. Instead of the locally limited correction of the transmission function shown in FIG. 5, this correction also can be performed so that the point H is displaced more toward the null point on the basic prior art transmission function.

The disclosure in German Patent Application 1 96 12 498.0 of Mar. 29, 1996 is incorporated here by reference. A claim of priority under 35 U.S.C. 119 is based on this German Patent Application which also discloses the same invention as described herein and claimed in the appended claims.

While the invention has been illustrated and described as embodied in a gear machine with an improved gear device, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We Claim:

1. A gear machine comprising a housing(3);

a pressurized chamber (5) for a hydraulic medium in the housing;

a lower pressure chamber(4) for the hydraulic medium communicating with the pressurized chamber (5) in the housing; and a gear device (1,2) separating the pressurized chamber (5) from the lower pressure chamber (4);

wherein the gear device (1,2) comprises two gear wheels rotatably mounted in the housing, said two gear wheels consisting of a driving wheel (1) and a driven wheel (2) and having engaging or meshing gear teeth (21,22) shaped so that an instantaneous volume flow rate, $dV/d\phi_1$, of the hydraulic medium past the gear teeth (21,22) is changed according to an angular position goof the driving wheel (1) and so that said two gear wheels have a transmission function $i=d\phi_1/d^{SM}{}_2$, $\phi_2$ being an angular position of the driven wheel (2), selected so that the driven wheel (2) is operated with a continuously changing angular speed repeating periodically over each gear teeth division, whereby volume flow rate fluctuations resulting from continuous position change of a sealing boundary at an instantaneous contact point (Y) between the engaging or meshing gear teeth (21,22) of said two gear wheels (1,2) are at least partially compensated by feeding more or less of said hydraulic medium between said chambers (5,4), and wherein the shape of the flanks or sides (25,26) of the engaging or meshing gear teeth (21,22) of said two gear wheels (1,2) is such that the transmission function i depends on a spacing ($g_{\alpha y}$) of said instantaneous contact point (Y) from a pitch point (C) of said two gear wheels (1,2) and changes continuously with a continuous derivative and said derivative is zero at a gear tooth engagement change point occurring at a maximum value of said spacing ($g_{\alpha y}$) of said instantaneous contact point (Y) from the pitch point (C).

2. The gear machine as defined in claim 1 and comprising a gear pump.

3. The gear machine as defined in claim 1 and comprising a gear motor.

4. The gear machine as defined in claim 1, wherein said transmission function i is determined according to the following equation III:

$$(dV/d\varphi_1) = \{V_g/2\pi\}[1 - f(g_{\alpha y})] = : \frac{b}{2}\cdot\left[\left(r_{a1}^2 + \frac{1}{i}r_{a2}^2\right) - \frac{1}{1+i}a_w^2 - \left(1+\frac{1}{i}\right)g_{\alpha y}^2\right]. \quad \text{(III)}$$

wherein said $r_{a1}$ and $r_{a2}$ are the crown circle radii for the driving and driven wheels (1,2) respectively, b is a gear tooth width, $a_w$ is a center distance between said two gear wheels, $g_{\alpha y}$ is the spacing of said instantaneous contact point (Y) from said pitch point (C), $V_g/2\pi$ represents a maximum instantaneous feed volume and $f(g_{\alpha y})$ represents a variation from constant volume flow rate.

5. The gear machine as defined in claim 4, wherein said $f(g_{\alpha y})$ is set equal to zero during determination of the transmission function i.

6. The gear machine as defined in claim 1, wherein the shape of the flanks or sides (25,26) of the engaging or meshing gear teeth (21,22) of said two gear wheels (1,2) is such that the transmission function $i(g_{\alpha y})$ has an arc-shaped bend (13) having a derivative equal to zero at said maximum value of said spacing ($g_{\Phi y}$) at one end thereof and said transmission function $i(g_{\Phi y})$ has a continuous derivative in a region in which said arc-shaped bend (13) merges or joins a basic transmission function ($i(g_{\alpha y})$) at another end thereof.

* * * * *